US005084800A

United States Patent [19]

Hijikata

[11] Patent Number: 5,084,800

[45] Date of Patent: Jan. 28, 1992

[54] IGNITION TRANSFORMER SECONDARY WINDING BY-PASS APPARATUS

[75] Inventor: Yasuhiro Hijikata, Iruma, Japan

[73] Assignee: Yokogawa Aviation Company, Ltd., Iruma, Japan

[21] Appl. No.: 489,418

[22] Filed: Mar. 5, 1990

[30] Foreign Application Priority Data

Dec. 15, 1989 [JP] Japan ..... 1-325577

[51] Int. Cl.[5] ..... F23G 3/00; H05B 37/02

[52] U.S. Cl. ..... 361/257; 315/209 M; 361/263

[58] Field of Search ..... 361/247, 253, 256, 257, 361/263, 251; 315/209 M

[56] References Cited

U.S. PATENT DOCUMENTS 3,383,553 5/1968 Parish et al. ..... 315/183
4,034,270 7/1977 Matthews ..... 361/256
4,167,767 9/1979 Courier de Méré361 ..... 256/
4,247,880 1/1981 Morio ..... 361/256
4,261,025 4/1981 Chafer et al. ..... 361/257
4,983,886 1/1991 Balland ..... 315/209 CD

*Primary Examiner*—J. R. Scott
*Assistant Examiner*—Richard T. Elms
*Attorney, Agent, or Firm*—Moonray Kojima

[57] ABSTRACT

In a capacitive discharge type ignition apparatus, in which an ignition transformer is used, the impedance of the secondary winding of the ignition transformer is comparatively large. This means the power loss is large and the efficiency, in applying a high power voltage to an igniter plug, is lowered. In this invention, a low impedance bypass circuit is connected in parallel circuit with the secondary winding of the ignition transformer, so that the spark current flows through the bypass circuit. By this arrangement, the power loss in the secondary winding is made to be substantially zero. Thus, a powerful spark is generated in the igniter plug efficiently, reliably and with simple circuitry.

5 Claims, 3 Drawing Sheets

IGNITION TRANSFORMER SECONDARY WINDING BY-PASS APPARATUS

BACKGROUND OF THE INVENTION

1. Field of Invention

This invention relates to a capacitive discharge type ignition apparatus using an ignition transformer; and more particularly, to an improvement thereof wherein efficiency is greatly increased.

2. Description of the Prior Art

FIG. 5 shows a block diagram of a prior ignition apparatus, wherein AC power is applied to a primary winding of a step-up transformer $T_{r1}$ and AC voltage is obtained from a secondary winding thereof. The obtained AC voltage is half-wave rectified with a diode $D_1$, which then charges a tank condenser $C_1$. When the voltage level stored in tank condenser $C_1$ reaches the discharging voltage level of a spark gap $G_1$, a trigger current $i_t$ flows through a primary winding of an ignition transformer $T_{r2}$, which is connected to a trigger condenser $C_2$ so that a high voltage is induced in a secondary winding of ignition transformer $T_{r2}$.

The other end of the secondary winding of ignition transformer $T_{r2}$ is corrected to an igniter plug P. When the isolation gap between the electrodes of plug P is broken down by the high voltage, a high power ignition spark occurs and a spark current $i_s$ flows through the secondary winding of ignition transformer $T_{r2}$.

However, the prior ignition apparatus has many deficiencies. For example, since the impedance of the secondary winding of the ignition transformer is comparatively large, power loss is high, and therefore, efficiency is degraded considerably.

SUMMARY OF THE INVENTION

An object of the invention is to overcome the aforementioned and other deficiencies of the prior art.

A further object is to provide an ignition apparatus which prevents the lowering of output efficiency and which has a simple structure.

The foregoing and other objects and features are attained by the invention wherein a low impedance bypass circuit is connected between both ends of the secondary winding of the ignition transformer so as to cause the spark current to flow through the bypass circuit instead of the secondary winding. Accordingly, power loss at the secondary winding of the ignition transformer is minimized to substantially zero. Thus, a powerful spark is generated in the igniter plug, with high efficiency, reliability and simple circuitry.

DETAILED DESCRIPTION OF THE PREFERRED EMBODIMENTS

Figure 1:
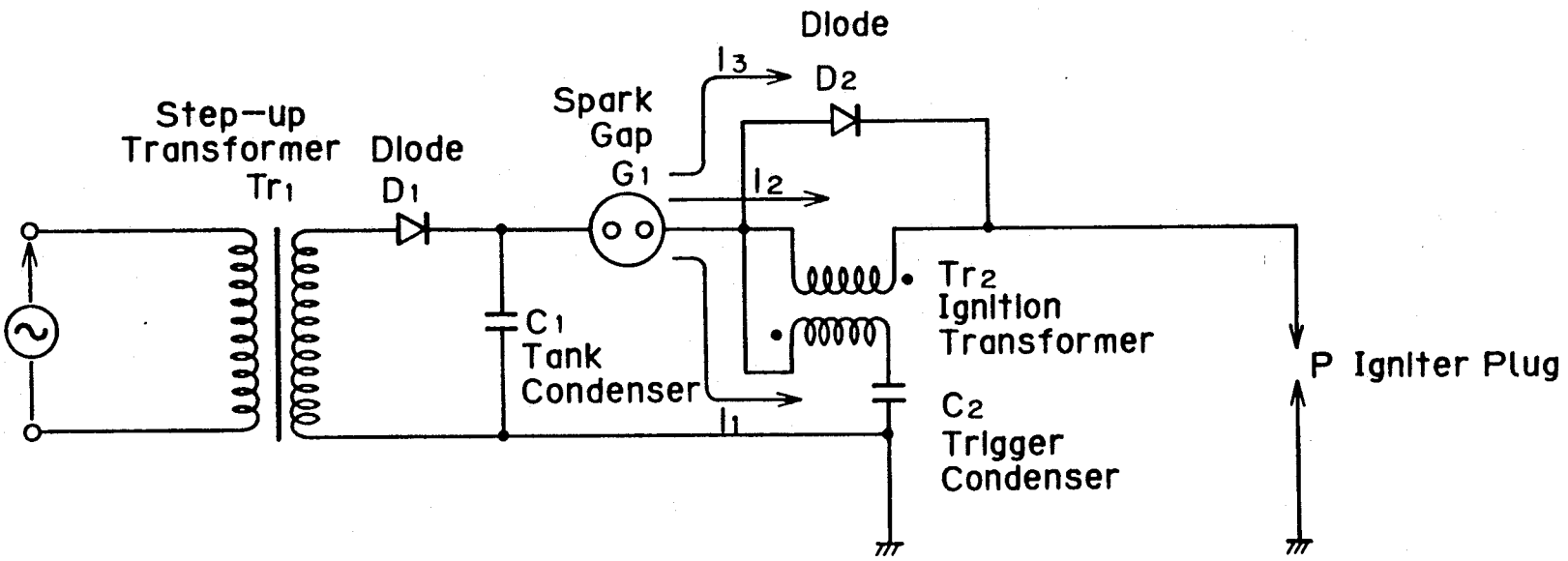
FIG. 1 is a block diagram depicting an illustrative embodiment of the invention.
Figure 5:
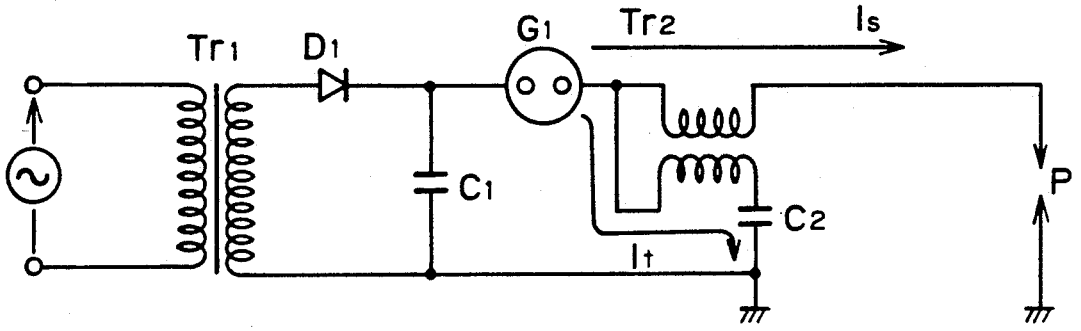
FIG.5 (PRIOR ART)
FIG. 5 is a block diagram depicting a conventional ignition apparatus.

In FIG. 1, the same components as in FIG. 5 bear the same notations and will not be further described for sake of clarity of description. FIG. 1 differs from FIG. 5 in the use of a bypass circuit comprising a diode $D_2$ connected in parallel across the secondary winding of the ignition transformer $T_{r2}$. This bypass circuit causes the spark current to bypass the secondary winding.

By this arrangement of FIG. 1, a high voltage is induced in the secondary winding of ignition transformer $T_{r2}$ in the same manner as in the FIG. 5 circuit. Igniter plug P is triggered by the high voltage and a spark is generated therebetween.

Since the impedance of the bypass circuit, comprising diode $D_2$, and which is connected in parallel circuit across the secondary winding of the ignition transformer $T_{r2}$, is low in the direction which a current $i_3$ flows, a major part of the spark current $i_3$ flows through diode $D_2$. Accordingly, power loss at the secondary winding of ignition transformer $T_{r2}$ is minimized to substantially zero, and a powerful spark is generated in plug P, efficiently and reliably and simply.

Figure 2:
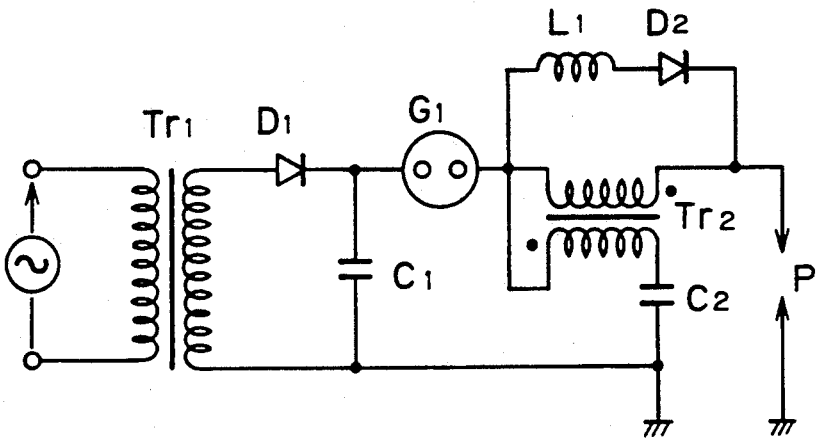
FIG. 2 is a block diagram depicting another illustrative embodiment of the invention.

FIG. 2 depicts another embodiment wherein the ignition characteristic is improved further by use of a waveform shaping coil $L_1$ connected in series circuit to diode $D_2$, as the bypass circuit.

Figure 3:
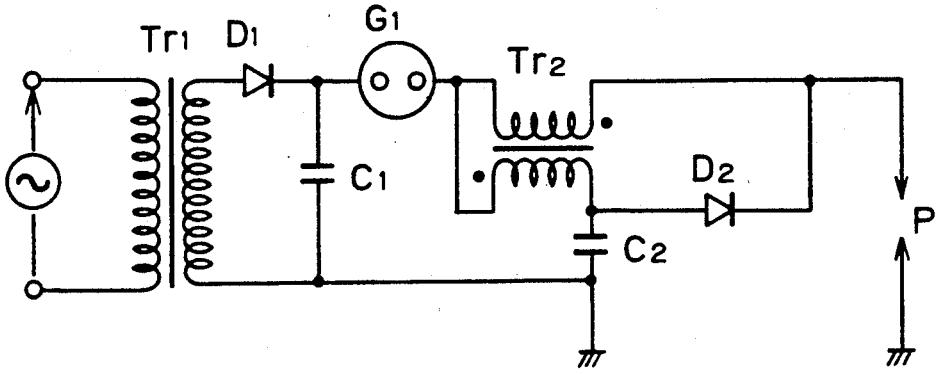
FIG. 3 is a block diagram depicting a further illustrative embodiment of the invention.

FIG. 3 depicts a further embodiment wherein the primary winding of the ignition transformer $T_{r2}$ serves as both the primary winding of the ignition transformer $T_{r2}$ and as the waveform shaping coil, such as shown in the FIG. 2 embodiment. In the embodiment, the diode $D_2$ is shown connected to the primary winding of the ignition transformer $T_{r2}$ and the igniter plug P.

Figure 4:
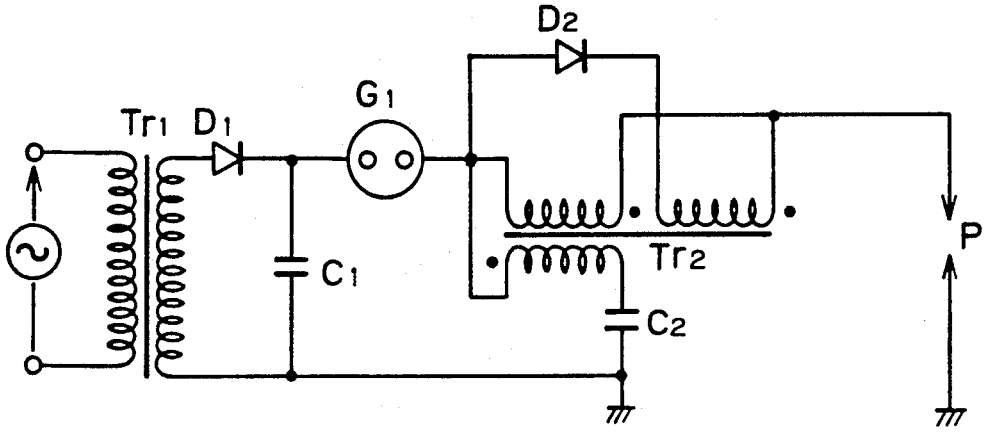
FIG. 4 is a block diagram depicting a still further illustrative embodiment of the invention.

FIG. 4 depicts a still further embodiment wherein a tertiary winding is provided on ignition transformer $T_{r2}$, and the bypass circuit comprises diode $D_2$ connected to the tertiary winding which is then connected to the igniter plug P, as depicted. The tertiary winding is used in place of the waveform shaping coil $L_1$ of FIG. 2. When the polarity of the secondary winding of ignition transformer $T_{r2}$ is matched with the polarity of the tertiary winding of ignition transformer $T_{r2}$, as shown in FIG. 4, reverse voltage applied to diode $D_2$ is minimized.

One advantage obtained by the invention is the increase in efficiency. The efficiency of an ignition exciter is given by the following equation:

$$\text{Efficiency (\%)} = 100 \times \frac{\text{Spark Energy}}{\text{Electrostatic Energy stored in a Condenser}}$$

In a conventional apparatus, the efficiency is limited to about 20%. However, in the instant invention, for example, in the FIG. 3 embodiment, the following excellent experimental results were obtained. When the energy stored in the condenser was 2 Joules, 0.65 Joule was obtained as the spark energy in the plug. Thus, the efficiency using the invention was increased to be 32.5%.

Another advantageous effect attained by the invention is that since the spark current does not flow into the secondary winding of the ignition transformer $T_{r2}$, the diameter of the secondary winding can be made to be smaller. Hence, the size of the ignition coil can be miniaturized.

Furthermore, it is possible to increase the winding ratio between the primary winding and the secondary winding without lowering the efficiency. Thus, high voltage output is easily attained. Also, advantageously, since the voltage of the primary winding is low, the circuit structure is considerably simplified.

What is claimed is:

1. An ignition apparatus comprising a step-up transformer comprising a primary winding and a secondary winding;

a series circuit, comprising a first diode and a first capacitor, connected across said secondary winding of said step-up transformer;

a spark gap having two terminals, one terminal thereof connected to a junction between said first diode and said first capacitor;

a second capacitor having one terminal thereof connected to said first capacitor;

an igniter plug;

an ignition transformer comprising a primary winding and a secondary winding, one end of said primary winding thereof connected to the other terminal of the spark gap and another end of said primary winding thereof connected to another terminal of said second capacitor, and one end of said secondary winding thereof connected to said other terminal of said spark gap and another terminal of said secondary winding thereof connected to said igniter plug; and bypass circuit means for causing sparking current to substantially bypass said secondary winding of said ignition transformer, said bypass circuit means being connected to said ignition transformer and to said igniter plug.

2. The apparatus of claim 1, wherein said bypass circuit means comprises a second diode connected across said secondary winding of said ignition transformer.

3. The apparatus of claim 1, wherein said bypass circuit means comprises a series circuit connected across said ignition transformer, said series circuit comprising a second diode and a choke.

4. The apparatus of claim 1, wherein said bypass circuit means comprises a second diode having one terminal thereof connected to said other end of said primary winding of said ignition transformer and another terminal thereof connected to said igniter plug.

5. The apparatus of claim 1, wherein said ignition transformer further comprises a tertiary winding; and wherein said bypass circuit means comprises a second diode and said tertiary winding.

* * * * *